United States Patent [19]

La Belle et al.

[11] Patent Number: 4,620,075

[45] Date of Patent: Oct. 28, 1986

[54] UNITIZED CONTROL PANEL

[75] Inventors: John T. La Belle, Long Beach; Robert S. Szemeredi, Tujunga; Matthew G. Tarnay, Pasadena, all of Calif.

[73] Assignee: Price Pfister, Inc., Pacoima, Calif.

[21] Appl. No.: 742,572

[22] Filed: Jun. 7, 1985

Related U.S. Application Data

[63] Continuation of Ser. No. 502,925, Jun. 10, 1983, abandoned.

[51] Int. Cl.[4] ..... H01H 13/70; H01H 3/12

[52] U.S. Cl. ..... 200/159 B; 200/5 A; 200/340; 200/243

[58] Field of Search ..... 200/5 A, 159 B, 159 R, 200/340, 333, 306, 243, 83 Z, 85 R, 86 R; 340/365 C; 361/288

[56] References Cited

U.S. PATENT DOCUMENTS

| | | | |
|---|---|---|---|
| 3,627,975 | 12/1971 | Spievak | 200/5 R |
| 3,643,041 | 2/1972 | Jackson | 200/5 A |
| 4,035,593 | 7/1977 | Riniker | 200/159 B X |
| 4,066,860 | 1/1978 | Kawasaki | 200/159 B X |
| 4,143,179 | 3/1979 | Nishikata et al. | 400/694 X |
| 4,172,216 | 10/1979 | O'Shea | 200/85 R |
| 4,249,054 | 2/1981 | Komaki | 200/159 B |
| 4,293,754 | 10/1981 | Komaki | 200/159 B |
| 4,338,502 | 7/1982 | Hashimoto et al. | 200/159 B |
| 4,365,130 | 12/1982 | Christensen | 200/306 |

FOREIGN PATENT DOCUMENTS

| | | | |
|---|---|---|---|
| 2500701 | 7/1975 | Fed. Rep. of Germany | 200/159 B |

*Primary Examiner*—Stephen Marcus
*Assistant Examiner*—Ernest G. Cusick
*Attorney, Agent, or Firm*—Blakely, Sokoloff, Taylor & Zafman

[57] ABSTRACT

Individual switch actuators are formed by etching offset grooves in opposite sides of a thin metal plate. The groove on one side of the plate falls just within the groove on the other side of the plate. A web is formed between the adjacent groove walls which provides significant localized flexibility. A discrete contact pad is defined on the inside that is in the plane of the metal plate.

6 Claims, 7 Drawing Figures

UNITIZED CONTROL PANEL

This application is a continuation, of application Ser. No. 502,925, filed June 10, 1983, now abandoned.

FIELD OF INVENTION

This invention relates to a control panel, plate or keyboard which is in the form of a thin metal sheet, different regions of which may be depressed, as by digital pressure, to cause a conductive element to bridge circuit strips of a circuit board.

BACKGROUND OF THE INVENTION

Known switch control panels are generally of two types, perforate and imperforate. One type has holes through which movable button actuators project. Foreign particles can enter the interior via the through clearance spaces between the holes and the buttons. Such a panel is difficult to clean. The imperforate type utilizes a thin plate that provides an environmental seal with the case. Such a plate is easily cleaned. The thin plate has suitable legends and actuator regions printed or etched on its surface. Digital pressure at the actuator regions causes flexure which, in turn, causes switch members beneath the plate to engage. Since flexure at the point of application of digital pressure produces proportionate flexure at adjacent regions, some means must be provided for discrete mechanical movement to prevent unintended closure of adjacent switches. One method is shown and described in U.S. Pat. No. 4,249,054 issued Feb. 3, 1981 to Sharp Kabushiki Kaisha as assignee.

In the Sharp structure, a broad area of a stainless steel cover plate is uniformly etched to provide a flexible membrane. A rubber support sheet is laminated to the membrane. A spacer sheet of electrical insulation material is interposed between the membrane laminate and a circuit board. The circuit board has pairs of contact areas or segments arrayed about the board surface. The spacer sheet has access openings about the pairs of contact segments. A conductive rubber pad carried by the membrane laminate is located at each spacer sheet opening. The spacer sheet is just slightly thicker than the pads. If one actuator area of the stainless steel plate is engaged, only its companion conductive pad protrudes beyond the plane of the spacer sheet to engage the contact segments of the circuit board. Adjacent pads remain slightly recessed within the plane of the insulator sheet.

A structure of this type, while entirely operational, requires an extremely thin localized switch actuator for flexibility such as about 0.03 millimeters or 0.012 inches. Metal this thin is easily punctured, and is subject to fatigue failure.

In a structure shown and described in U.S. Pat. No. 4,293,754 issued Oct. 6, 1981 to Sharp Kabushiki Kaisha as assignee, discrete motion is accomplished through removal of the material around all but a portion of the pad. This provides discrete motion but has the disadvantage in that openings are formed around the pad that allow liquid and contaminants to enter the switching system.

The primary object of the present invention is to provide a simple system utilizing a relatively thick imperforate cover plate in which the material of the cover plate itself serves as the bridging contact element.

SUMMARY OF THE INVENTION

In order to accomplish the foregoing objective, independent switch actuators are formed by etching a perimetric groove on the outside of the cover plate to define each actuator, and by etching a registering, but just slightly inwardly offset, perimetric groove on the inside of the cover plate. A thin web is thus formed between the adjacent recess walls which provides localized flexibility, all without undue reduction in wall thickness. A contact pad is formed on the inside of the cover plate that is in the plane of the cover plate itself. A simple spacer sheet is interposed between the cover plate and the circuit board on which contact segment pairs are formed. The spacer sheet has holes to expose the contact pad to the corresponding pair of contact segments. No supplemental conductive pads or the like are required to build up a contactor. The resulting structure is simple and effective.

BRIEF DESCRIPTION OF THE DRAWINGS

A detailed description of the invention will be made with reference to the accompanying drawings wherein like numerals designate corresponding parts in the several figures.

DETAILED DESCRIPTION OF THE PREFERRED EMBODIMENT

The following detailed description is of the best presently contemplated mode of carrying out the invention. This description is not to be taken in a limiting sense, but is made merely for purposes of illustrating the general principles of the invention, since the scope of the invention is best defined by the appended claims. Structural and operational characteristics attributed to forms of the invention first described shall also be attributed to forms later described, unless such characteristics are obviously inapplicable or unless specific exception is made.

Figure 1:
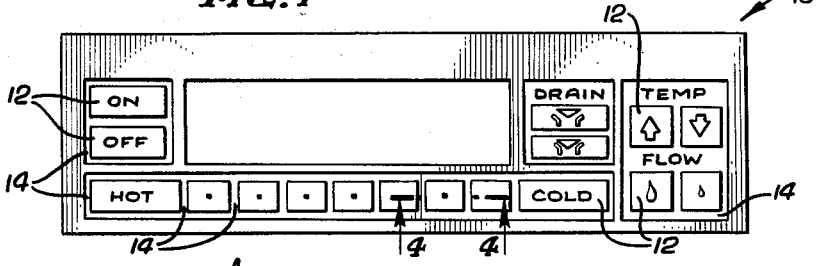
FIGS. 1 and 2 are top and bottom plan views of a typical metal cover plate incorporating the present invention.

In FIG. 1 there is illustrated a control panel or cover plate 10 made of stainless steel having a thickness of approximately 0.100 millimeters or 0.040 inches. The panel 10, in the present instance, and by way of example only, is intended to cooperate with a digital processor for controlling the flow of water to a bath spout or other outlet. The panel 10 accordingly provides a number (seventeen in this instance) of discrete switch actuators 12. The actuators, square and rectangular, in the present instance are defined by shallow grooves or channels 14 etched or otherwise formed on the surface of the panel 10.

Figure 2:
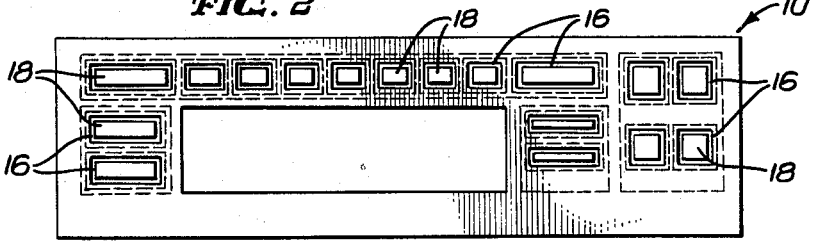
Figure 4:
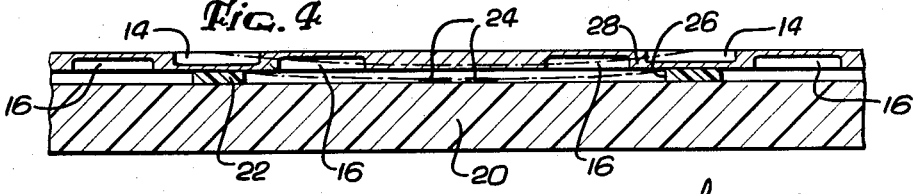
FIG. 4 is an enlarged fragmentary transverse sectional view of the switch assembly incorporating the cover plate of FIGS. 1 and 2 and the spacer sheet of FIG. 3.

Flexibility of the individual actuators 12 is provided not by the grooves 14 alone, but also by grooves or channels 16 etched on the undersurface of the panel 10 as shown in FIGS. 2 and 4. The grooves 16 on the undersurface generally parallel the grooves 14 on the top, except that they are just inwardly offset therefrom to define a series of square and rectangular contact pads 18 as shown in FIG. 2. Each groove 14 or 16 leaves about 0.250 millimeters or 0.010 inches of metal between its bottom and the opposite surface. The depth of the grooves is thus about two-thirds or three-quarters of the thickness of the cover plate itself.

The individual contact pads 18 form elements of a switch assembly shown in FIG. 4. The assembly includes, in addition to the cover plate 10, a circuit board 20 and a spacer sheet 22 made of electrical insulation material. The circuit board 20 has pairs of contact segments 24 arrayed in alignment with the contact pads 18. Holes 26 in the spacer sheet 22 expose the contact segments.

As indicated in dotted lines, digital pressure on the actuator 12 causes flexure of the cover plate 10 so that the pad 18 engages and bridges the contact segments 24.

The cover plate 10 is significantly flexible at each of the actuators 12 without causing proportionate flexure at the adjacent actuators. Thus, the web 28 between the offset shallow grooves 14 and 16 provides a relatively isolated region of flexure.

Figure 3:
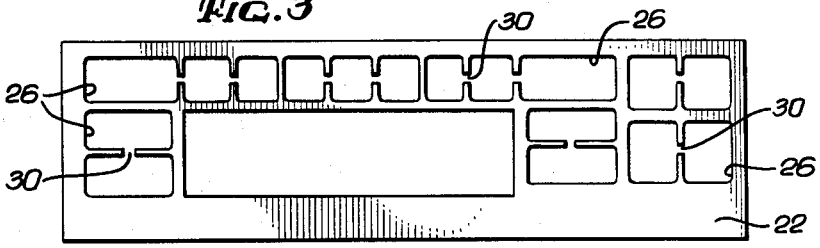
FIG. 3 is a bottom plan view of the spacer sheet.

The cover plate 10 preferably is a unitary structure. However, it may be made as a laminate, or it may be made by plating a conductive layer on the inner side in order to provide the requisite electrical bridging function for the contact segments. Each of the holes 26 in the spacer sheet 22, as shown in FIG. 3, laterally joins an adjacent hole 26 as by a small slot or cut 30. This provides a bleed space to prevent any significant transient buildup of air pressure upon depression of the actuator. The shift of air also assists in isolating the region of cover plate flexure, further ensuring against spurious bridging of adjacent contact segments.

DESCRIPTION OF ALTERNATIVE EMBODIMENTS

Figure 6:
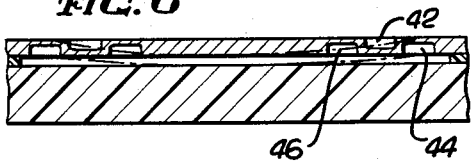
FIGS. 6 and 7 are enlarged fragmentary sectional views of switch assemblies using, respectively, sets of three and sets of four offset grooves.
Figure 5:
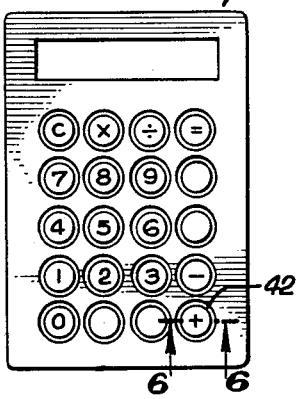
FIG. 5 is a view illustrating a cover plate of a hand calculator and showing circular switch actuators.

The configuration of individual actuators and the array of actuators is unrestricted. For example, in FIG. 6 there is illustrated a panel 40 for a hand held calculator. In the present instance, the individual actuators are circular and formed by circular grooves 42 on the top and a pair of offset circular grooves 44 and 46 at the bottom. The grooves on the top, in the present instance, are non-contiguous, contrary to the arrangement of the grooves in the form of FIGS. 1 to 5. One of the grooves 46 on the surface opposed to the circuit board (not shown) is inwardly offset in order to obtain the desired flexibility and movement. Greater flexibility is achieved by adding the outwardly offset grooves 44.

Figure 7:
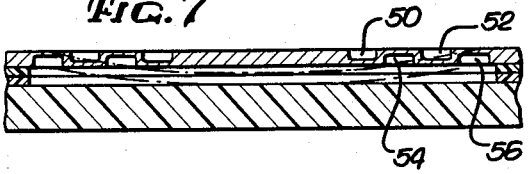

In FIG. 7, four offset grooves 50, 52, 54 and 56 are provided to define each actuator, two on the top and two on the bottom. By increasing the number of offset grooves, the material of the cover plate can be made thicker, while achieving the same net flexibility.

Intending to claim all novel, useful and unobvious features shown or described, we make the following claims:

We claim:

1. In a unitized switch control panel:

(a) a flat, thin cover plate made of electrically conductive, flexible and resilient material having an outer surface and an inner surface lying is spaced, parallel planes;

(b) said plate having on its outer surface, first grooves defining a plurality of discrete actuators in the normal, unflexed condition of said plate, which are of unrestricted configuration and array, said actuators having digitally engageable surfaces substantially coplanar with said outer surface of said cover plate;

(c) said plate having on its inner surface, second grooves substantially paralleling the first grooves but laterally offset therefrom in directions parallel to the said planes of said cover plate surfaces;

(d) said second grooves defining contact pads for said actuators substantially in said plane of said inner surface of said plate;

(e) a circuit board having a plurality of pairs of contact segments arrayed to be bridged by said actuator pads when said actuator pads are depressed by digital pressure; and (f) an insulation spacer in contact with the circuit board on one side and said panel on the other, and having a plurality of apertures for said pairs of contact segments.

2. The control panel as set forth in claim 1 in which said plate is made of stainless steel of approximately 0.100 millimeters or 0.040 inches in thickness, said grooves extending approximately two-thirds of the thickness of the plate.

3. In a unitized switch control panel:

(a) a flat cover plate having an electrically conductive inner surface and having an outer surface, said surfaces lying in closely spaced parallel planes;

(b) said plate having a plurality of switch actuators;

(c) each actuator being formed by a series of continuous grooves present when the plate is in its unflexed state and located on opposite surfaces of the cover plate, the grooves on one surface of the plate substantially paralleling the grooves on the other surface of the plate, but being laterally offset from each other in directions parallel to the said planes of the plate to form narrow webs between the respective grooves that extend substantially perpendicular to said plane;

(d) said offset grooves defining, on the inside of the cover plate, a contact pad normally in said plane of the said inner surface but substantially individually flexible upon substantially aligned digital pressure on the opposite outside surface to bridge a pair of contact segments.

4. In a unitized switch control panel:

(a) a cover plate made of steel having a thickness of approximately 0.040 inches sufficient to utilize the strength and durability characteristics of the steel, said plate having an outer surface and an inner surface lying in spaced parallel planes:

(b) a switch contact pad defined from the material of said steel by two endless grooves, one on the outer surface of the plate, and one on the inner surface of the plate, said grooves extending inwardly of said surfaces when said plate is in its normal, unflexed, flat state:

(c) said grooves circumscribing two areas, a smaller one on the inner surface of said plate and a larger one on the outer surface of said plate that are substantially aligned, the said area on the outer surface having a peripheral edge encompassing and being just outwardly spaced from the outer edges of said groove on said inner surface are projected into the plane of said larger area thereby to impart flexibility to the contact pad in a direction perpendicular to the plane of said plate whereby a selectively positionable contact bridge is formed.

5. In a unitized switch control panel:

(a) a substantially planar cover plate having an outer surface and an inner surface lying in spaced parallel planes, said inner surface being substantially uniformly electrically conductive;

(b) said plate having on its outer surface, first grooves defining a plurality of discrete actuators in the normal, unflexed condition of said plate, which are of unrestricted configuration and array, said actuators having digitally engageable surfaces substantially coplanar with said outer surface of said cover plate;

(c) said plate having on its inner surface, second grooves substantially paralleling the first grooves but laterally offset therefrom in directions parallel to the said planes of said cover plate surfaces;

(d) said second grooves defining contact pads for said actuators substantially in said plane of said inner surface of said contact pads.

6. The apparatus as set forth in claim 5 together with a circuit board having a plurality of pairs of contact segments arrayed to be bridged by said actuator pads; and an electrical insulation film or sheet interposed between said cover plate and said circuit board, said insulation film or sheet having apertures for permitting engagement of actuator pads with their corresponding pair of contact segments.

* * * * *